US006334279B1

(12) United States Patent
Oliver et al.

(10) Patent No.: US 6,334,279 B1
(45) **Date of Patent: *Jan. 1, 2002**

(54) ADJUSTABLE OUTRIGGER FOR MANUFACTURED HOME

(76) Inventors: James Oliver; Evon L. Oliver, both of P.O. Box 58, Hohenwald, TN (US) 38462

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/186,102

(22) Filed: Nov. 5, 1998

(51) Int. Cl.[7] ..... E04G 21/26; E04G 25/06; E04D 27/48; B66F 3/08

(52) U.S. Cl. ..... 52/127.2; 52/143; 52/299; 52/DIG. 11; 248/354.3; 254/100

(58) Field of Search ..... 52/127.2, 126.6, 52/126.7, 143, 292, 299, 169.6, 657, 693, 632, DIG. 11; 248/351, 354.1, 354.3, 357, 200.1; 254/98, 100, 101, 133 A

(56) References Cited

U.S. PATENT DOCUMENTS

| | | | | | |
|---|---|---|---|---|---|
| 826,124 | A | * | 7/1906 | Soseman | 248/354.3 X |
| 891,897 | A | * | 6/1908 | Astrom | 248/357 X |
| 2,470,396 | A | * | 5/1949 | Guerette | 248/354.1 |
| 3,139,277 | A | * | 6/1964 | Mears | 248/354.3 X |
| 3,171,627 | A | * | 3/1965 | Tapley et al. | 248/354.3 |
| 3,208,725 | A | * | 9/1965 | Fleming | 248/354.3 X |
| 3,606,231 | A | * | 9/1971 | Kilborn | 248/354.3 |
| 3,704,560 | A | | 12/1972 | Ratliff, Jr. | |
| 4,010,584 | A | | 3/1977 | Barnes, Jr. | |
| 4,261,149 | A | | 4/1981 | Gustafson | |
| 4,304,078 | A | * | 12/1981 | Meriwether, Jr. | 52/127.2 |
| 4,348,843 | A | | 9/1982 | Cairns et al. | |
| 4,417,426 | A | | 11/1983 | Meng | |
| 4,546,581 | A | * | 10/1985 | Gustafson | 52/169.9 |
| 4,880,203 | A | * | 11/1989 | Holcomb et al. | 254/98 X |
| 4,899,497 | A | | 2/1990 | Madl, Jr. | |
| 4,937,989 | A | * | 7/1990 | Miyares et al. | 52/126.6 X |
| 4,976,077 | A | | 12/1990 | Tucker | |
| D323,716 | S | * | 2/1992 | Shook et al. | D25/127 |
| 5,085,398 | A | * | 2/1992 | Holcomb et al. | 249/24 |
| 5,105,598 | A | * | 4/1992 | Wilcox | 52/693 X |
| 5,271,596 | A | * | 12/1993 | Holomb et al. | 249/24 |
| 5,301,480 | A | | 4/1994 | Oyama et al. | |
| 5,359,821 | A | | 11/1994 | Merriman | |
| D368,569 | S | | 4/1996 | Winslow et al. | |
| 5,524,854 | A | * | 6/1996 | McSwain et al. | 248/354.1 |
| 5,607,134 | A | * | 3/1997 | Corning et al. | 248/354.3 |
| 5,680,732 | A | * | 10/1997 | Skouras | 52/126.1 |
| 5,681,021 | A | * | 10/1997 | Noll | 248/357 |
| 5,809,719 | A | * | 9/1998 | Ashton et al. | 248/354.3 X |
| 6,212,830 | B1 | * | 4/2001 | MacKarvich | 52/127.2 |

FOREIGN PATENT DOCUMENTS

| | | | | |
|---|---|---|---|---|
| CH | 259761 | * | 6/1949 | 248/357 |
| SE | 219827 | * | 4/1968 | 52/127.2 |

* cited by examiner

*Primary Examiner*—Laura A. Callo
(74) *Attorney, Agent, or Firm*—Calif Tervo

(57) ABSTRACT

An adjustable outrigger (10) for manufactured home (60) spans between lower end (76) of main beam (70) and outer end (83) of transverse floor joist (80) for supporting outer end (83). Outrigger (10) has a longitudinal axis (21) and generally comprises an elongate central portion (20) of adjustable length, a lower end (12) adapted to be supported by lower end (76) of beam (70) such that outrigger (10) can exert a longitudinal force on beam (70) over varying vertical angles of longitudinal axis (21) and an upper end (17) adapted for supporting outer end (83) of joist (80) such that outrigger (10) can exert a longitudinal force on joist (80) over a plurality of vertical angles of longitudinal axis (21).

7 Claims, 2 Drawing Sheets

FIG. 1
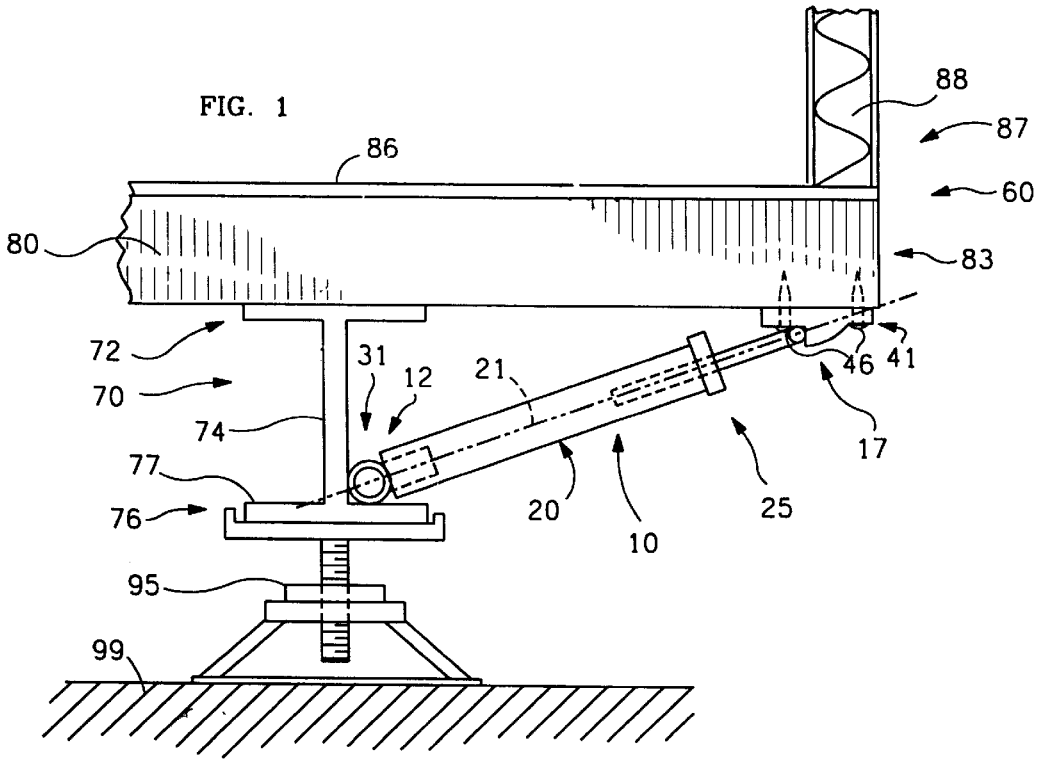
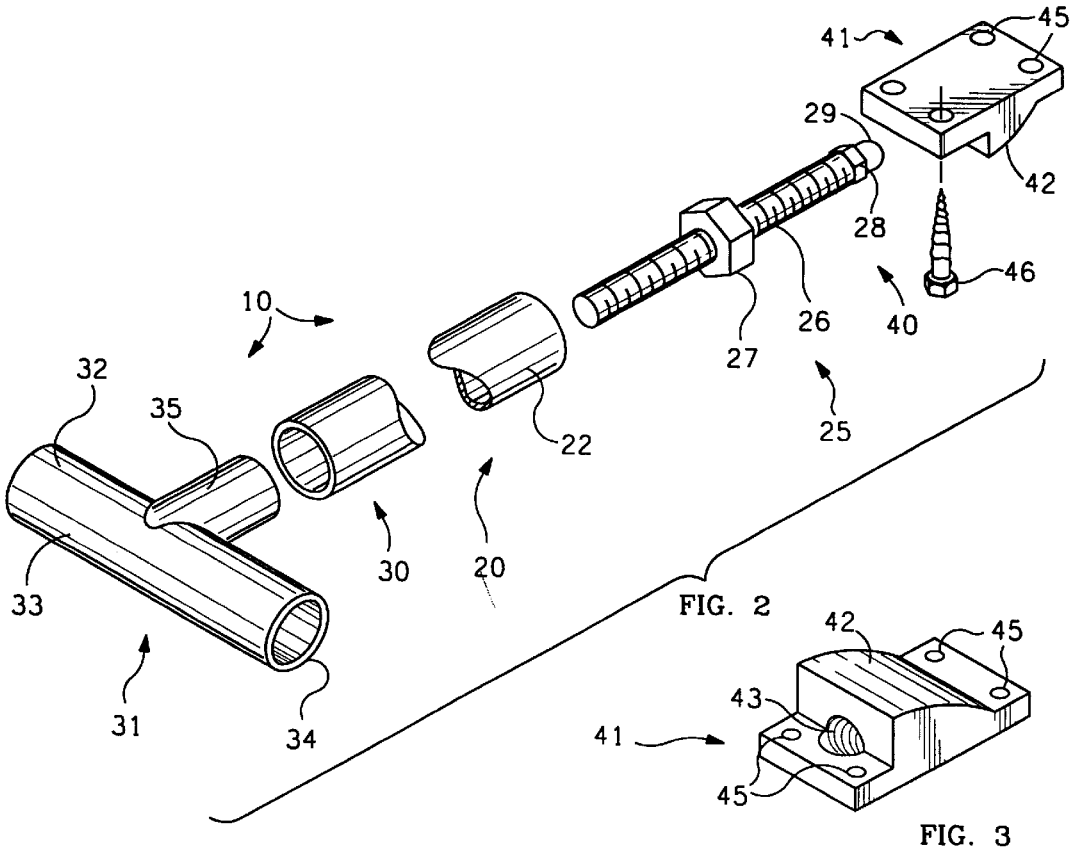
FIG. 2
FIG. 3

FIG. 4
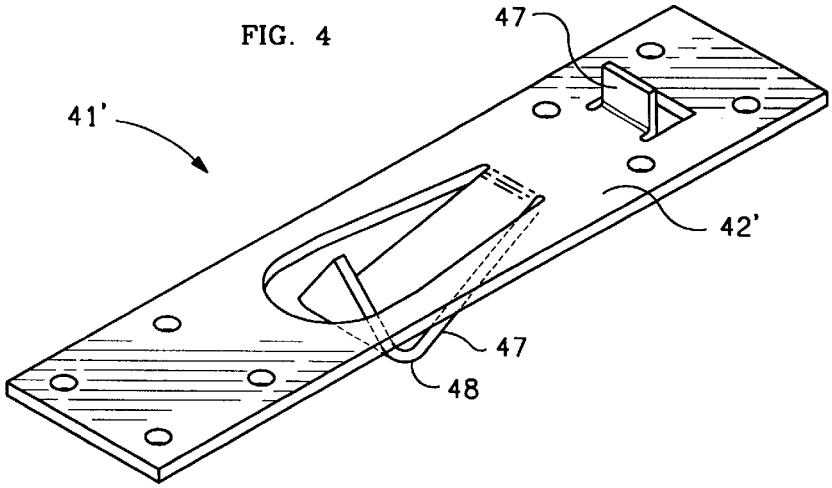
FIG. 5
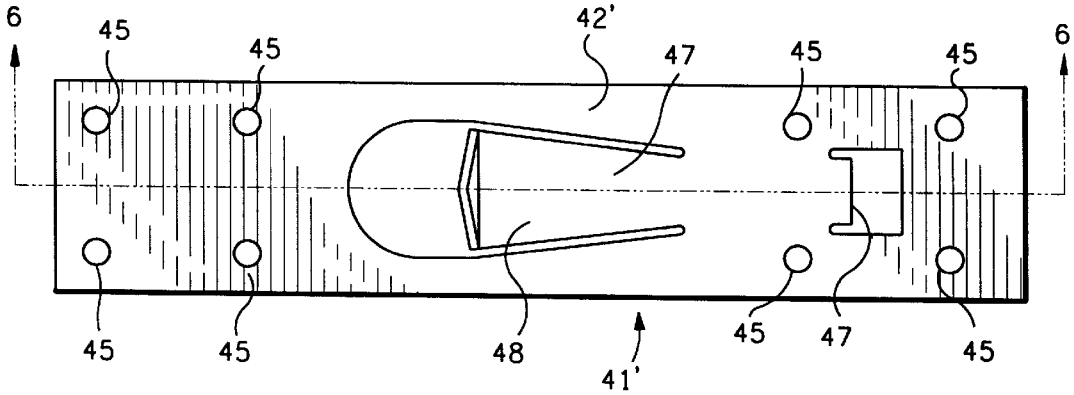
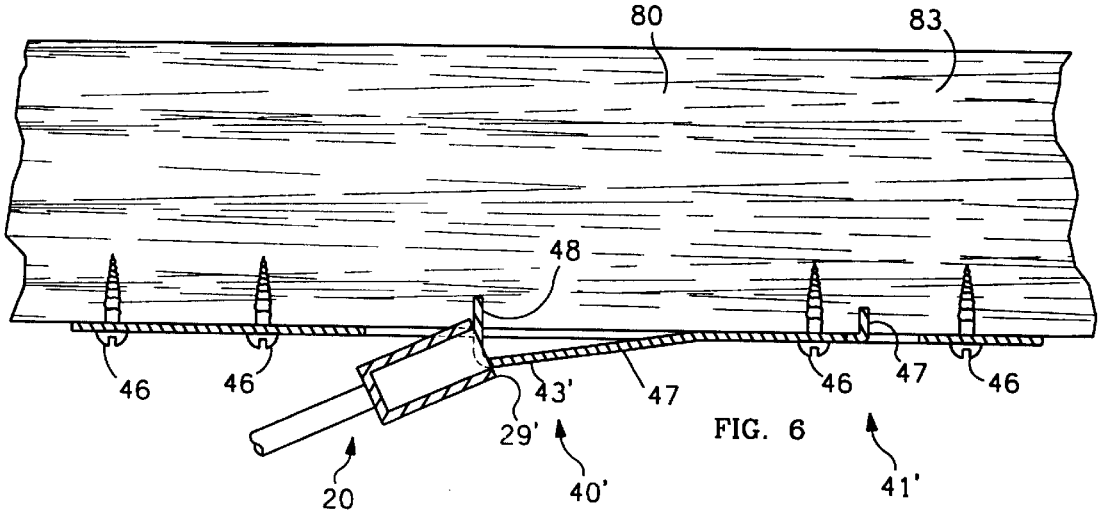
FIG. 6

ADJUSTABLE OUTRIGGER FOR MANUFACTURED HOME

BACKGROUND OF THE INVENTION

1. Field of the Invention

This invention relates to a support for the periphery of a manufactured home, mobile home or trailer coach, and more specifically to a slanted adjustable-length support between a main beam and an outer end of a floor joist.

2. Description of the Related Art

A manufactured home typically includes one or more longitudinal main I-beams which support a plurality of transverse floor joists which directly support the floor and the wall structure including wall studs.

A plurality of spaced support piers support the main beams. The home perimeter, i.e. the ends of the joists, are supported as necessary by vertical perimeter jacks disposed between the ground and the outer end of the joists. Perimeter jacks, spaced about the periphery of the coach and on the mating line or marriage seam between home sections, provide additional support to the outer ends of floor joists as necessary; for example to even the floor, to compensate for large local loads or to compensate for adjacent large wall openings.

Conventional perimeter jacks have several disadvantages. For example, it is common for the support piers to settle and to settle by differing amounts such that the load on a particular perimeter pier will increase to unacceptable levels, even failure level. Also, support piers need frequent adjustment to even the loading on the main beams. Each such adjustment requires that the perimeter jacks be adjusted also.

Therefore, there has been a need for means for supporting the periphery of a manufactured home that overcomes the shortcomings of the prior art.

SUMMARY OF THE INVENTION

This invention is an adjustable outrigger for a manufactured home. The outrigger spans between the lower end of a main beam and the outer end of a transverse floor joist for supporting the outer end of the joist. The outrigger has a longitudinal axis and generally comprises an elongate central portion of adjustable length including a lower end adapted to be supported by the lower end of the main beam such that the outrigger can exert a longitudinal force on the beam over varying vertical angles of the longitudinal axis and an upper end adapted to be supported by the distal end of the joist such that the outrigger can exert a longitudinal force on the joist over a plurality of vertical angeles of the longitudinal axis.

In an exemplary embodiment, a beam connector connected to the lower end of the central portion includes arcuate bearing surfaces and a joist connector pivotally connected to the upper end of the central portion.

In an alternate embodiment, the joist connector includes a spike that is further driven into the joist by longitudinal force and a downward protruding portion of the spike functions as a hinge bearing for the central portion.

Other features and many attendant advantages of the invention will become more apparent upon a reading of the following detailed description together with the drawings in which like reference numerals refer to like parts throughout.

BRIEF DESCRIPTION OF THE DRAWINGS

FIG. 1 is a partial front elevation view of a preferred embodiment of the outrigger of the invention in use on a manufactured home.

FIG. 2 is a partially cut away exploded perspective view of the outrigger of FIG. 1.

FIG. 3 is an inverted perspective of the joist anchor of FIG. 2.

FIG. 4 is a perspective view of an alternate embodiment of the upper end of the outrigger.

FIG. 5 is a bottom plan view of the joist connector of the embodiment of FIG. 4.

FIG. 6 is a sectional view taken on line 6—6 of the joist connector of FIG. 5 as attached to a joist.

DETAILED DESCRIPTION OF THE INVENTION

With reference now to drawings, FIG. 1 shows typical structural elements of a manufactured home 60. The term manufactured home 60 includes mobile homes and trailer coaches. The structural elements typically include a plurality, typically a pair, of large main beams, such as I-beam 70, running the length of home 60, supporting a plurality of floor joists, typically transverse joists, such as joist 80, supporting a plurality of wall studs, such as stud 88.

Each I-beam 70 is typically supported at a plurality of locations along its length by support piers, such as support pier 95, of adjustable height. Support pier 95 is supported by the ground or foundation 99.

I-beam 70 has an upper end 72, a vertical web 74 and a lower end 76 including a flange 77. Upper end 72 supports floor joist 80 at a distance from its outer end 83.

Floor joist 80 supports everything above it including floor 86 and walls, including outer wall 87. Outer end 83 of joist 80 supports outer wall 87 of home 60 including wall studs 88.

Outrigger 10, having longitudinal axis 21 and length adjustment means 25, spans between lower end 76 of main beam 70 and outer end 83 of joist 80 and supports outer end 83. Outrigger 10 includes a lower end 12 adapted to be supported by lower end 76 of beam 70 such that outrigger 10 can exert a force along longitudinal axis 21, hereinafter a "longitudinal force", on beam 70, preferably, over various vertical angles of longitudinal axis 21, more preferably, over an arc. Outrigger 10 includes an upper end 17 adapted to be supported by outer end 83 of joist 80 such that outrigger 10 can exert a longitudinal force on joist 80, preferably, over various vertical angles of longitudinal axis 21, and more preferably, over an arc.

Looking also at FIG. 2, outrigger 10 generally includes an elongate central portion 20 having a lower end 30 and an upper end 40. A majority of the length comprises a strong rigid member, such as metal pipe 22. Length adjustment means 25 adjusts the length of outrigger 10 so as to exert a longitudinal force on beam 70 and outer end 83 of joist 80 for supporting outer end 83. Length adjustment means 25 includes threaded rod 26, adjustment nut 27, and integral or fixed nut 28. Threaded rod 26 includes an end disposed in pipe 22. Length is adjusted by hold one nut, e.g. 27 and turning the other, e.g. 28. The specific length adjustment means illustrated and described is only one of many possible and contemplated. Upper end 40 includes means, such as arcuate bearing surface 29, for pivotal mating attachment to joist connector 41.

Beam connector 31, connected to lower end 30 of central portion 20, is adapted to be upwardly supported by flange 77 and outwardly supported by web 74 such that outrigger 10 can exert a longitudinal force on beam 70. Pipe connector 35 couples with pipe 22. Beam connector 31 includes pivot means, such as horizontal cylindrical bearing member 32 having arcuate surfaces for bearing against web 74 and flange 77 for exerting longitudinal force while allowing outrigger 10 move in a vertical arc. Bearing member 32 has arcuate surfaces including a first cylindrical surface 33 for bearing against web 74 and a second cylindrical surface 34 for bearing against flange 77. Although arcuate-faced bearing member 32, shown, simply and rather elegantly performs the desired function, many other pivot means are contemplated and would be obvious to one skilled in the art.

A joist connector 41, connected to upper end 40 of central portion 20, is adapted to be supported by outer end 83 of joist 80 such that outrigger 10 can exert a longitudinal force on outer end 83. Attachment means, such as fasteners, such as screws or carriage bolts 46, in bores 45 attach body 42 to outer end 83. Body 42 includes mating connection means, such as concave arcuate surface 43, for mating hinged and pivotal attachment of bearing surface 29. Bearing 29 mates with bearing 43 such that outrigger 10 may exert a longitudinal force as longitudinal axis 21 moves in a vertical arc. Although, a specific pivotal mating connection between central portion 20 and joist connector 41 is shown, many others are possible and contemplated.

FIGS. 4–6 show an alternate embodiment of upper end 40' of outrigger 10. FIG. 4 is a perspective view of alternate upper end 40' of outrigger 10. FIG. 5 is a bottom plan view of the joist connector 41' of alternate upper end 40', and FIG. 6 is a sectional view of joist connector 41' taken on line 6—6 of FIG. 5 as attached to outer end 83 of joist 80.

Joist connector 41' is adapted to be supported by outer end 83 of joist 80 such that outrigger 10 can exert a longitudinal force on outer end 83. Body 42', made of strong material, such as a sheet of steel, is attached to outer end 83 of joist 80 by attachment means, such as fasteners, such as screws or carriage bolts 46, through bores 45 and one or more spikes, such as spikes 47 stamped out of the steel. Body 42' includes mating connection means, such as downward protruding bearing 43' of variable engaging spike 48, for mating hinged attachment of bearing surface 29'. Bearing 29' mates with bearing 43' such that outrigger 10 may exert a longitudinal force as longitudinal axis 21 moves in a vertical arc. Bearing 29' may be the open end of a cylinder, such as a pipe, that receives protruding portion 43' of spike 47. Longitudinal force from bearing 29' on spike bearing 43' serves to further drive spike 43' into joist 80 and strengthen the connection. Although, a specific pivotal mating connection between central portion 20 and joist connector 41 is shown, many others are possible and contemplated.

Having described the invention, it can be seen that slanted outrigger 10 provides a very desirable device for supporting the periphery of a manufactured home and replacing the prior art perimeter jacks. Importantly, each outrigger 10 typically needs to be adjusted only once and does not need further adjustment if support piers 95 are adjusted.

Although a particular embodiment of the invention has been illustrated and described, various changes may be made in the form, composition, construction, and arrangement of the parts without sacrificing any of its advantages. Therefore, it is to be understood that all matter herein is to be interpreted as illustrative and not in any limiting sense, and it is intended to cover in the appended claims such modifications as come within the true spirit and scope of the invention.

We claim:

1. A manufactured home including:

a main beam including:
an upper end;
a vertical web; and
a lower end;

a transverse floor joist supported by said upper end of said main beam; said joist including:
an outer end that is distal from said beam; and an outrigger spanning between said lower end of said beam and said outer end of said joist for supporting said outer end of said joist; said outrigger having a longitudinal axis and comprising:
an elongate central portion including:
a lower end supported by the lower end of the beam such that said outrigger can exert a force along said longitudinal axis of said outrigger on said beam;
an upper end including:
a joist connector supported by said outer end of said joist such that said outrigger can exert a force along said longitudinal axis of said outrigger on said outer end of said joist; and
length adjustment means for adjusting the length of said central portion such that said outrigger can exert a large force along said longitudinal axis of said outrigger.

2. The manufactured home of claim 1 wherein:

said lower end of said elongate central portion of said outrigger is adapted for exerting a longitudinal force over a plurality of vertical angles of the longitudinal axis.

3. The manufactured home of claim 2 wherein:

said joist connector is adapted for exerting a longitudinal force over a plurality of vertical angles of the longitudinal axis.

4. The manufactured home of claim 1 wherein:

said lower end of said elongate central portion of said outrigger is pivotable about a horizontal axis such that it may exert a longitudinal force over a plurality of vertical angles of the longitudinal axis.

5. The manufactured home of claim 1 wherein:

said lower end of said main beam includes:
a flange; and said lower end of said elongate central portion of said outrigger includes:
a surface for bearing against said web; and
a surface for bearing against said flange.

6. The manufactured home of claim 1 wherein:

said joist connector is adapted for exerting a longitudinal force over a plurality of vertical angles of the longitudinal axis.

7. The outrigger of claim 1 wherein:

said joist connector includes:
a body including:
a spike for penetrating the joist.

* * * * *